US010806965B2

(12) United States Patent
Lee et al.

(10) Patent No.: US 10,806,965 B2
(45) Date of Patent: Oct. 20, 2020

(54) MULTI-FUNCTION EXERCISE DEVICE

(71) Applicant: SUPERWEIGH ENTERPRISE CO., LTD., Nan-Tou Hsien (TW)

(72) Inventors: Sunny Lee, Nan-Tou Hsien (TW); Simon Chao, Nan-Tou Hsien (TW)

(73) Assignee: SUPERWEIGH ENTERPRISE CO., LTD. (TW)

( * ) Notice: Subject to any disclaimer, the term of this patent is extended or adjusted under 35 U.S.C. 154(b) by 110 days.

(21) Appl. No.: 16/160,860

(22) Filed: Oct. 15, 2018

(65) Prior Publication Data

US 2020/0114199 A1 Apr. 16, 2020

(51) Int. Cl.
*A63B 22/06* (2006.01)
*A63B 21/22* (2006.01)
(Continued)

(52) U.S. Cl.
CPC ..... *A63B 22/0664* (2013.01); *A63B 21/154* (2013.01); *A63B 21/225* (2013.01);
(Continued)

(58) Field of Classification Search
CPC ..... A63B 21/00058; A63B 21/00069; A63B 21/00072; A63B 21/00076; A63B 21/15; A63B 21/151; A63B 21/154; A63B 21/159; A63B 21/22; A63B 21/225; A63B 21/4027; A63B 21/4033; A63B 21/4034; A63B 21/4035; A63B 21/4045; A63B 21/4047; A63B 21/4049; A63B 22/001; A63B 22/0015; A63B 22/0017; A63B 22/0046; A63B 22/0048; A63B 22/0056; A63B 22/0664; A63B 2022/0051; A63B 2022/0053; A63B 2022/0676; A63B 2022/0682; A63B 23/035; A63B 23/03516; A63B 23/03575; A63B 23/04; A63B 23/0405; A63B 23/0423; A63B 23/0429; A63B 23/0482; A63B 23/0494;
(Continued)

(56) References Cited

U.S. PATENT DOCUMENTS 7,608,018 B2 * 10/2009 Chuang ..... A63B 22/001 482/52
7,651,445 B1 * 1/2010 Chen ..... A63B 22/001 482/51

(Continued)

FOREIGN PATENT DOCUMENTS

TW M325844 U 1/2008

*Primary Examiner* — Gary D Urbiel Goldner
(74) *Attorney, Agent, or Firm* — Lewis Roca Rothgerber Christie LLP

(57) ABSTRACT

A multi-function exercise device includes a supporting frame, a pair of linkage members, a first wheel unit, and a second wheel unit. Each of two first coupler bars couples a front link of the respective linkage member to the first wheel unit to permit rotation of the first wheel unit in response to upward movement of the front link of one of the linkage members. Each of two second coupler bars couples a rear link of the respective linkage member to the second wheel unit to permit rotation of the second wheel unit in response to swinging movement of the rear link. Two load-resistance members are provided for retarding rotations of the first and second wheel units, respectively.

10 Claims, 15 Drawing Sheets

(51) Int. Cl.
*A63B 21/00* (2006.01)
*A63B 22/00* (2006.01)

(52) U.S. Cl.
CPC ..... *A63B 21/4034* (2015.10); *A63B 21/4035* (2015.10); *A63B 22/001* (2013.01); *A63B 2022/0676* (2013.01)

(58) Field of Classification Search
CPC .... A63B 2023/0441; A63B 2023/0447; A63B 2023/0452; A63B 71/0054; A63B 2071/0063; A63B 2071/0072; A63B 2208/0204; A63B 2225/09; A63B 2225/093
See application file for complete search history.

(56) References Cited

U.S. PATENT DOCUMENTS 7,841,968 B1 * 11/2010 Eschenbach ..... A63B 21/225 482/52
8,029,416 B2 * 10/2011 Eschenbach ..... A63B 22/0017 482/52
8,376,913 B2 * 2/2013 Lee ..... A63B 22/001 482/52
9,511,253 B1 * 12/2016 Miller ..... A63B 22/001
9,757,609 B2 * 9/2017 Nishimura ..... A63B 21/015
9,849,332 B1 * 12/2017 Huang ..... A63B 21/4034
10,022,586 B1 * 7/2018 Lee ..... A63B 22/0015
10,022,588 B1 * 7/2018 Lee ..... A63B 23/03583
D864,315 S * 10/2019 Hume ..... A63B 22/0017 D21/670
2008/0161163 A1 * 7/2008 Stewart ..... A63B 22/0017 482/51
2008/0261777 A1 * 10/2008 Chuang ..... A63B 22/0015 482/52
2008/0261778 A1 * 10/2008 Chuang ..... A63B 22/0664 482/52
2008/0261779 A1 * 10/2008 Chuang ..... A63B 22/0664 482/52
2013/0035212 A1 * 2/2013 Chuang ..... A63B 22/001 482/52
2014/0194255 A1 * 7/2014 Huang ..... A63B 22/0015 482/52
2014/0194256 A1 * 7/2014 Huang ..... A63B 22/0664 482/52
2014/0221166 A1 * 8/2014 Huang ..... A63B 22/0015 482/52
2014/0248998 A1 * 9/2014 Lu ..... A63B 22/04 482/52
2017/0014675 A1 * 1/2017 Lai ..... A63B 22/0664
2017/0080282 A1 * 3/2017 Lai ..... A63B 22/0012

* cited by examiner

MULTI-FUNCTION EXERCISE DEVICE

FIELD

The disclosure relates to an exercise device, more particularly to a multi-function exercise device.

BACKGROUND

Taiwanese Utility Model Patent No. M325844U discloses a conventional exerciser capable of providing multiple foot motions. As shown in FIGS. 1 to 3, the conventional exerciser may include amounting frame unit 11, a linkage unit 12, and a transmission unit 13. The linkage unit 12 includes a main shaft 121 journalled on an upright rod 111 of the mounting frame unit 11, two swing rods 122 connected pivotally to the main shaft 121, two pedal rods 123 disposed respectively under the swing rods 122, two front links 124 each connected pivotally to the main shaft 121 and the corresponding pedal rod 123, and two rear links 125 each connected pivotally to the corresponding swing rod 122 and the corresponding pedal rod 123. The transmission unit 13 includes a pulley 131 disposed on an inverted L-shaped frame 112 of the mounting frame unit 11, a transmission cable 132 extending around the pulley 131 and fastened to the swing rods 122 for transmitting a motion between the swing rods 122, and two damping cylinders 133 each interconnecting the corresponding swing rod 122 and the inverted L-shaped frame 112 for retarding swinging movement of the corresponding swing rod 122. With such a configuration, the conventional exerciser allows the user to perform motions, such as those achievable by a glider exercise device, a stepper exercise device, an elliptical exercise device, etc., through operation of the front links 124 and by the user's control over the movement of the center of gravity of his or her feet. Taiwanese Utility Model Patent Nos. M327723U and M325845U also disclose similar conventional exercisers.

SUMMARY

An object of the disclosure is to provide a novel multi-function exercise device which permits the user to perform motions, such as those achievable by a glider exercise device, a stepper exercise device, an elliptical exercise device, etc.

According to the disclosure, a multi-function exercise device includes a supporting frame, a pair of linkage members, a first wheel unit, a second wheel unit, a pair of first coupler bars, a pair of second coupler bars, a first load-resistance member, and a second load-resistance member. The supporting frame includes a base configured to rest on a floor surface, a front support post extending upwardly from the base to terminate at an upper end segment, and a pivot shaft extending along a first pivot axis in a left-to-right direction through the upper end segment to terminate at a left shaft end segment and a right shaft end segment. The linkage members are respectively disposed leftward and rightward of the front support post. Each of the linkage members includes a rear link, a support link, a link extension, a front link, and a connection link. The rear link has a first lower link end, and a first upper link end which is opposite to the first lower link end in an upright direction, and which is pivotally coupled on a respective one of the left and right shaft end segments about the first pivot axis to permit swinging movement of the rear link about the first pivot axis. The support link has a first forward link end, and a first rearward link end which is opposite to the first forward link end in a forward-to-rearward direction, and which is pivotally coupled to the first lower link end about a second pivot axis parallel to the first pivot axis. The link extension extends rearwardly from the first rearward link end to form a foot support area. The front link has a second upper link end, and a second lower link end which is opposite to the second upper link end in the upright direction, and which is pivotally coupled to the first forward link end about a third pivot axis parallel to the first pivot axis. The connection link has a second rearward link end coupled pivotally to the first upper link end about the first pivot axis, and a second forward link end which is opposite to the second rearward link end in the forward-to-rearward direction, and which is pivotally coupled to the second upper link end about a fourth pivot axis parallel to the first pivot axis so as to permit the rear link, the support link, the front link, and the connection link to cooperatively form a four-bar linkage such that when a treading force is exerted on the foot support area about the second pivot axis, the first forward link end is permitted to move upward so as to make upward movement of the front link in the upright direction. The first wheel unit is disposed forwardly of the front support post, and is rotatably mounted relative to the front support post. The second wheel unit is disposed forwardly of the front support post, and is rotatably mounted relative to the front support post. Each of the first coupler bars is configured to couple the second upper link end of the front link of the respective linkage member to the first wheel unit so as to permit the first wheel unit to be driven to rotate in response to the upward movement of the front link of one of the linkage members. Each of the second coupler bars is configured to couple the first upper link end of the rear link of the respective linkage member to the second wheel unit so as to permit the second wheel unit to be driven to rotate in response to the swinging movement of the rear link about the first pivot axis. The first load-resistance member is disposed forwardly of the front support post to retard rotational movement of the first wheel unit. The second load-resistance member is disposed forwardly of the front support post to retard rotational movement of the second wheel unit.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
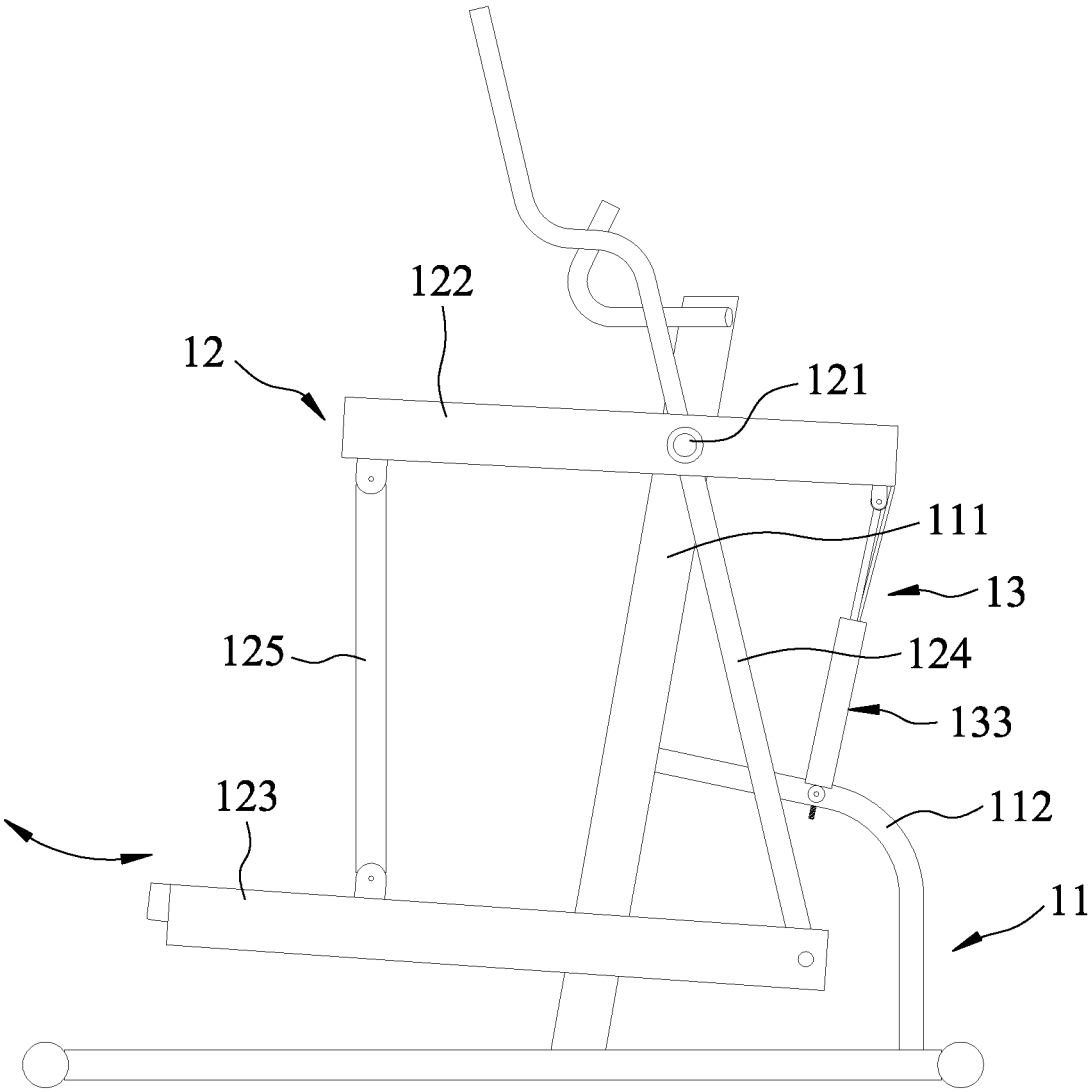
FIG.1 PRIOR ART
FIG. 1 is a side view of a conventional exerciser capable of providing multiple foot motions.
Figure 2:
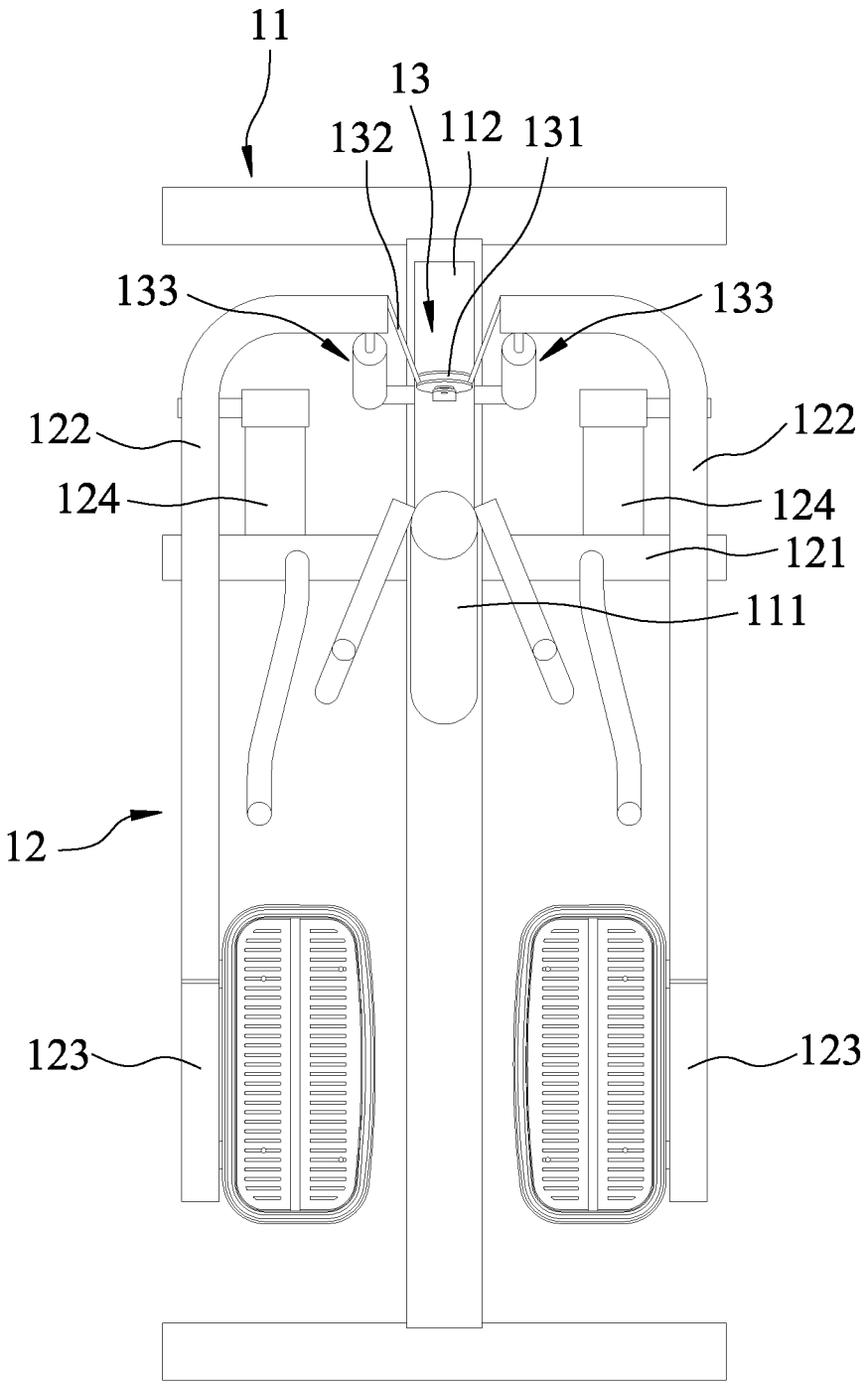
FIG.2 PRIOR ART
FIG. 2 is a top view of the conventional exerciser.
Figure 3:
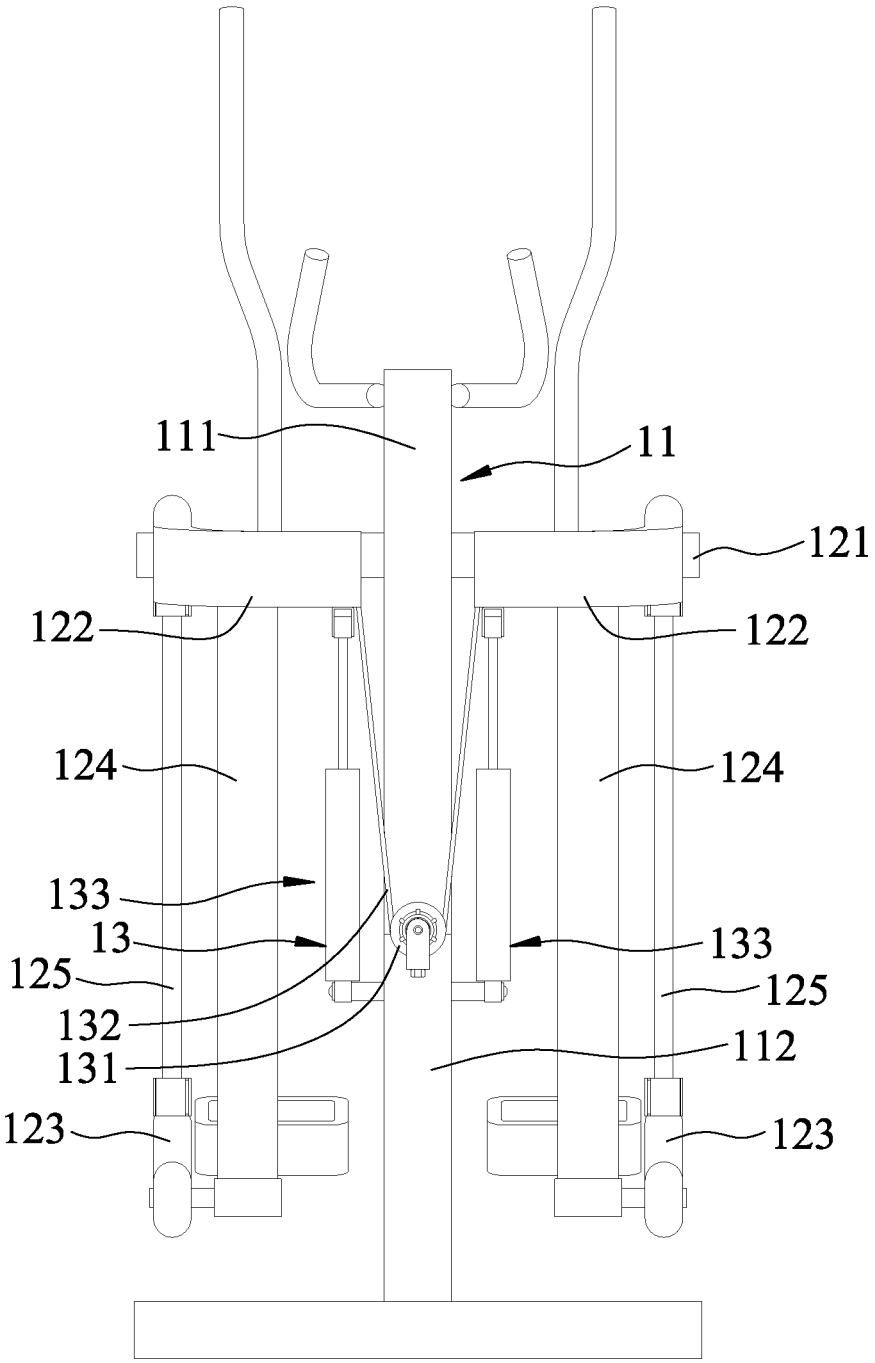
FIG.3 PRIOR ART
FIG. 3 is a front view of the conventional exerciser.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 4:
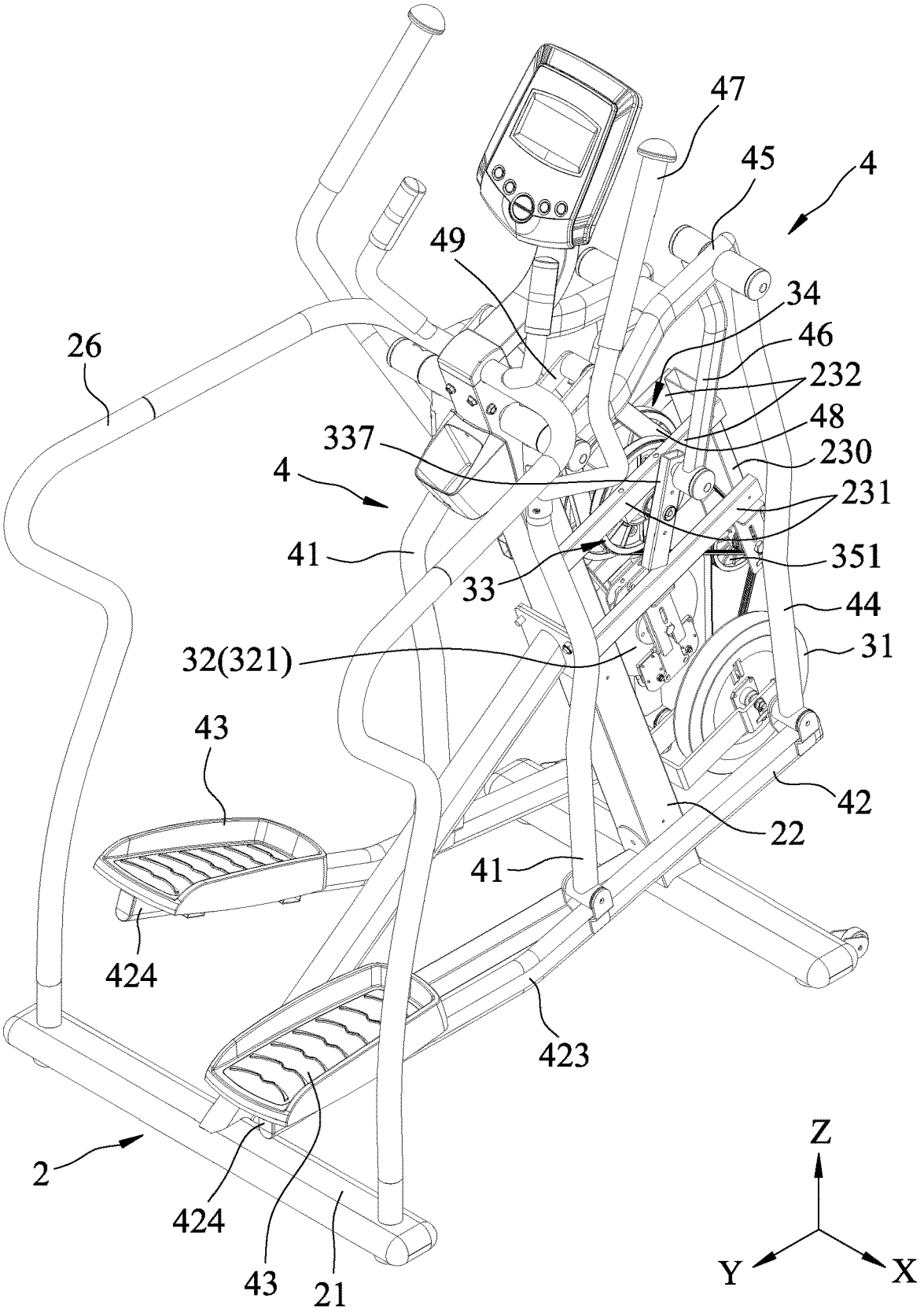
FIG. 4 is a perspective view of a multi-function exercise device according to a first embodiment of the disclosure.
Figure 5:
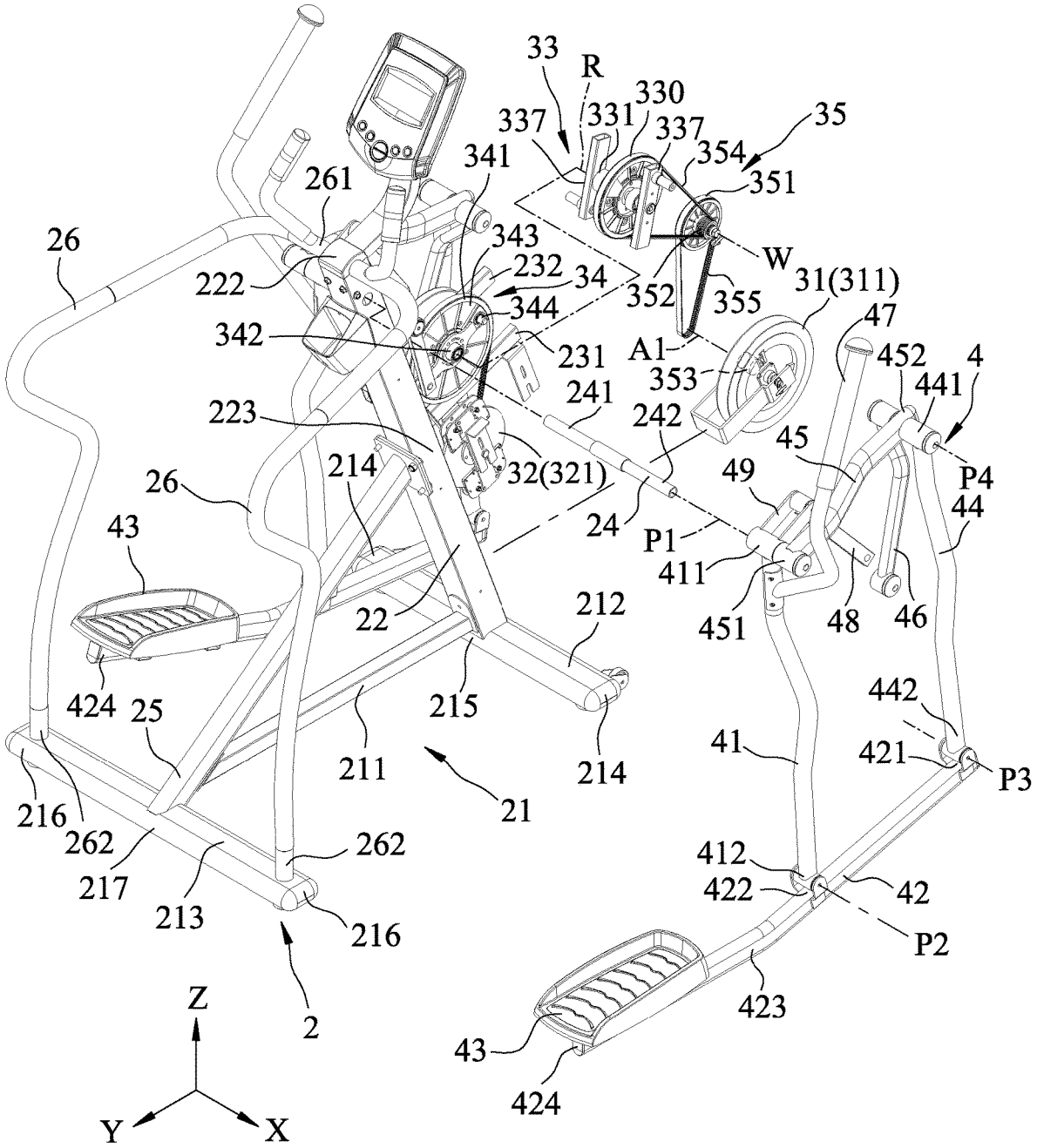
FIG. 5 is a partial exploded perspective view of the multi-function exercise device shown in FIG. 4, with certain parts omitted for better illustration.
Figure 6:
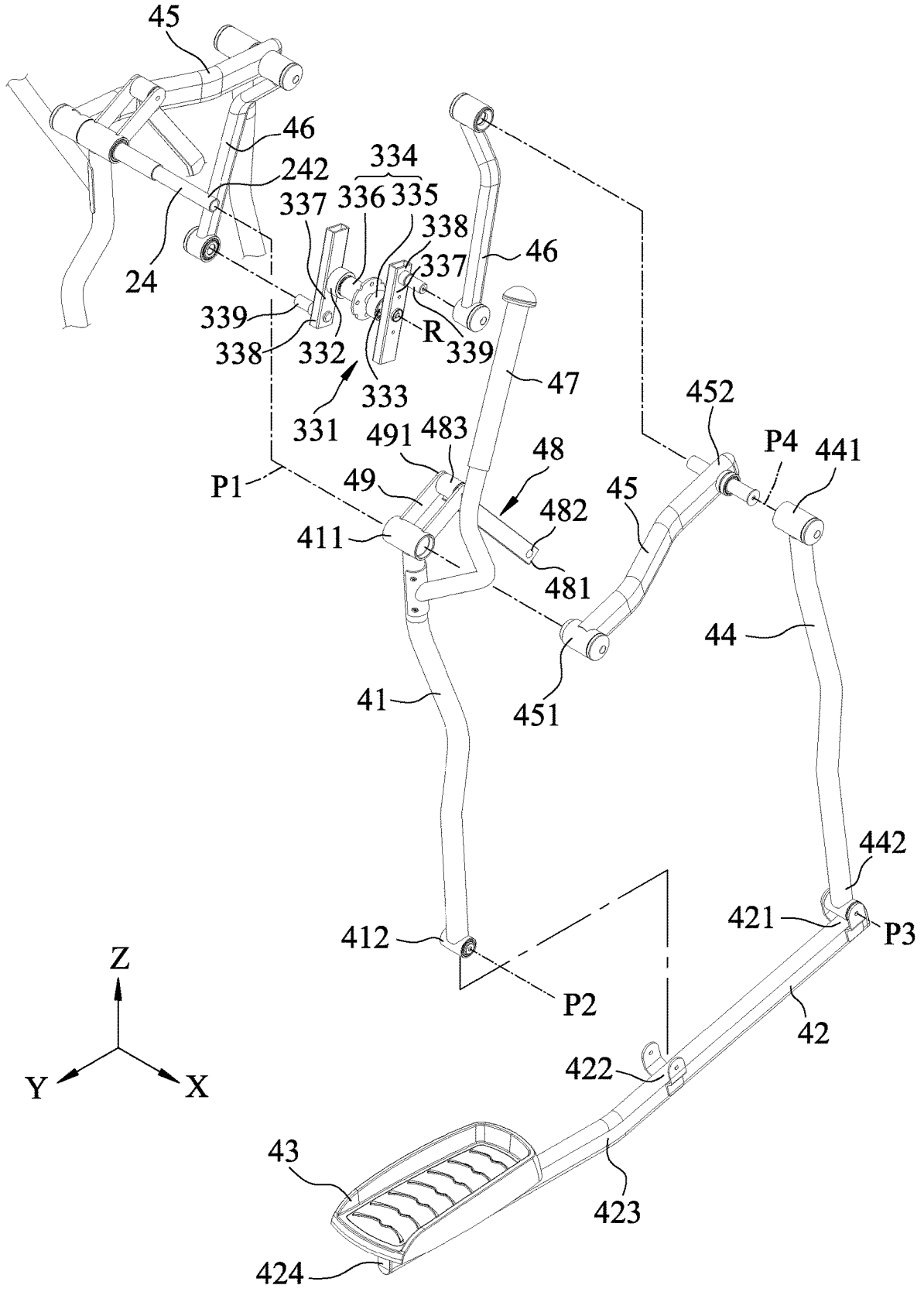
FIG. 6 is an enlarged, fragmentary, partially exploded perspective view of the multi-function exercise device shown in FIG. 4, with certain parts omitted for better illustration.

Referring to FIGS. 4 to 6, a multi-function exercise device according to a first embodiment of the disclosure is shown to include a supporting frame 2, a pair of linkage members 4, a first wheel unit 33, a second wheel unit 34, a pair of first coupler bars 46, a pair of second coupler bars 48, a first load-resistance member 31, and a second load-resistance member 32.

The supporting frame 2 includes a base 21 configured to rest on a floor surface, a front support post 22, and a pivot shaft 24. The front support post 22 extends upwardly from the base 21 to terminate at an upper end segment 222. The pivot shaft 24 extends along a first pivot axis (P1) in a left-to-right direction (X) through the upper end segment 222 to terminate at a left shaft end segment 241 and a right shaft end segment 242.

The linkage members 4 are respectively disposed leftward and rightward of the front support post 22. Each of the linkage members 4 includes a rear link 41, a support link 42, a link extension 423, a front link 44, and a connection link 45.

As shown in FIG. 5, the rear link 41 has a first lower link end 412, and a first upper link end 411 which is opposite to the first lower link end 412 in an upright direction (Z), and which is pivotally coupled on a respective one of the left and right shaft end segments 241, 242 about the first pivot axis (P1) to permit swinging movement of the rear link 41 about the first pivot axis (P1).

The support link 42 has a first forward link end 421, and a first rearward link end 422 which is opposite to the first forward link end 421 in a forward-to-rearward direction (Y), and which is pivotally coupled to the first lower link end 412 about a second pivot axis (P2) parallel to the first pivot axis (P1).

The link extension 423 extends rearwardly from the first rearward link end 422 to form a foot support area 424.

The front link 44 has a second upper link end 441, and a second lower link end 442 which is opposite to the second upper link end 441 in the upright direction (Z), and which is pivotally coupled to the first forward link end 421 about a third pivot axis (P3) parallel to the first pivot axis (P1).

Figure 8:
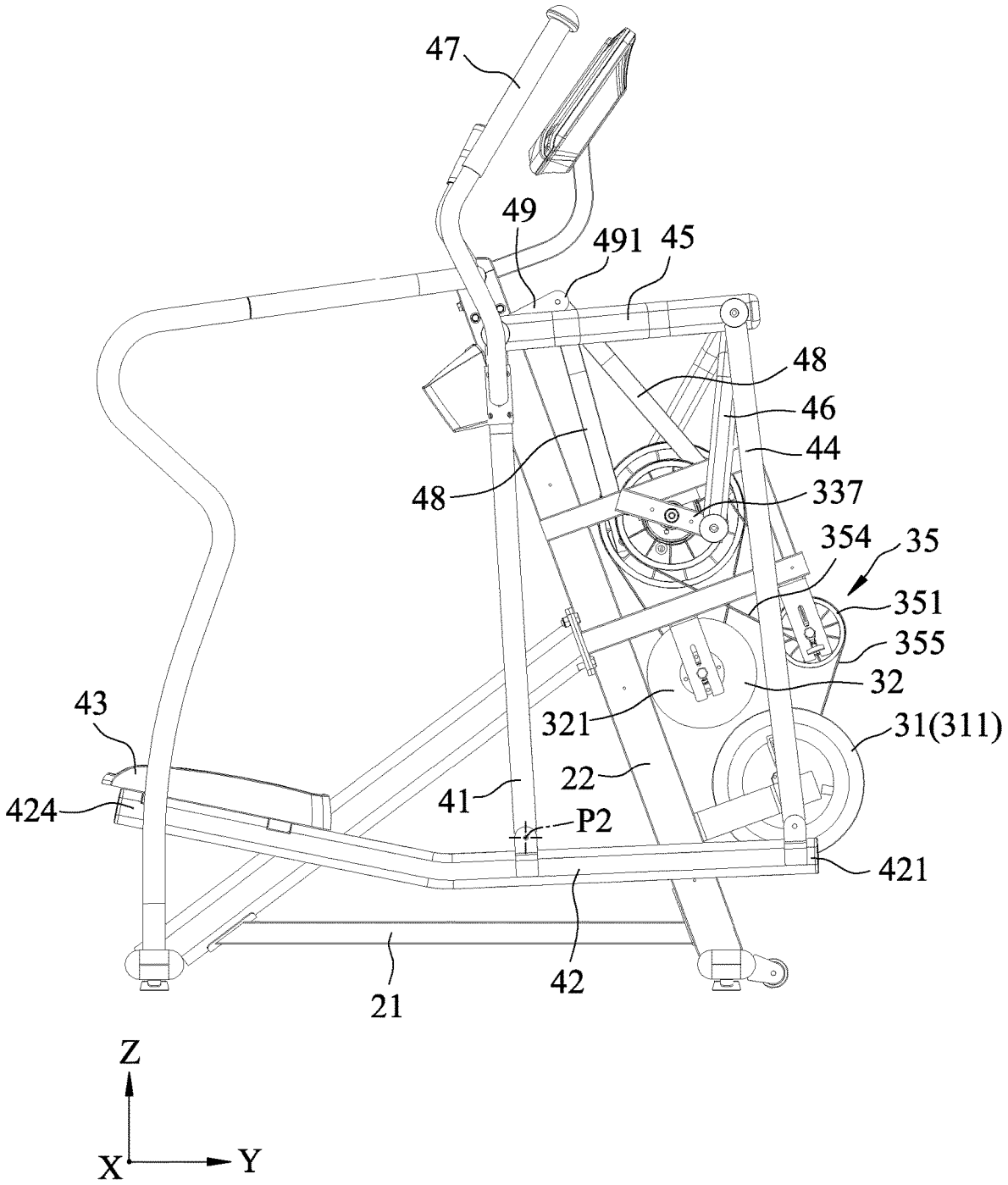
FIG. 8 is a side view of the multi-function exercise device shown in FIG. 4.
Figure 10:
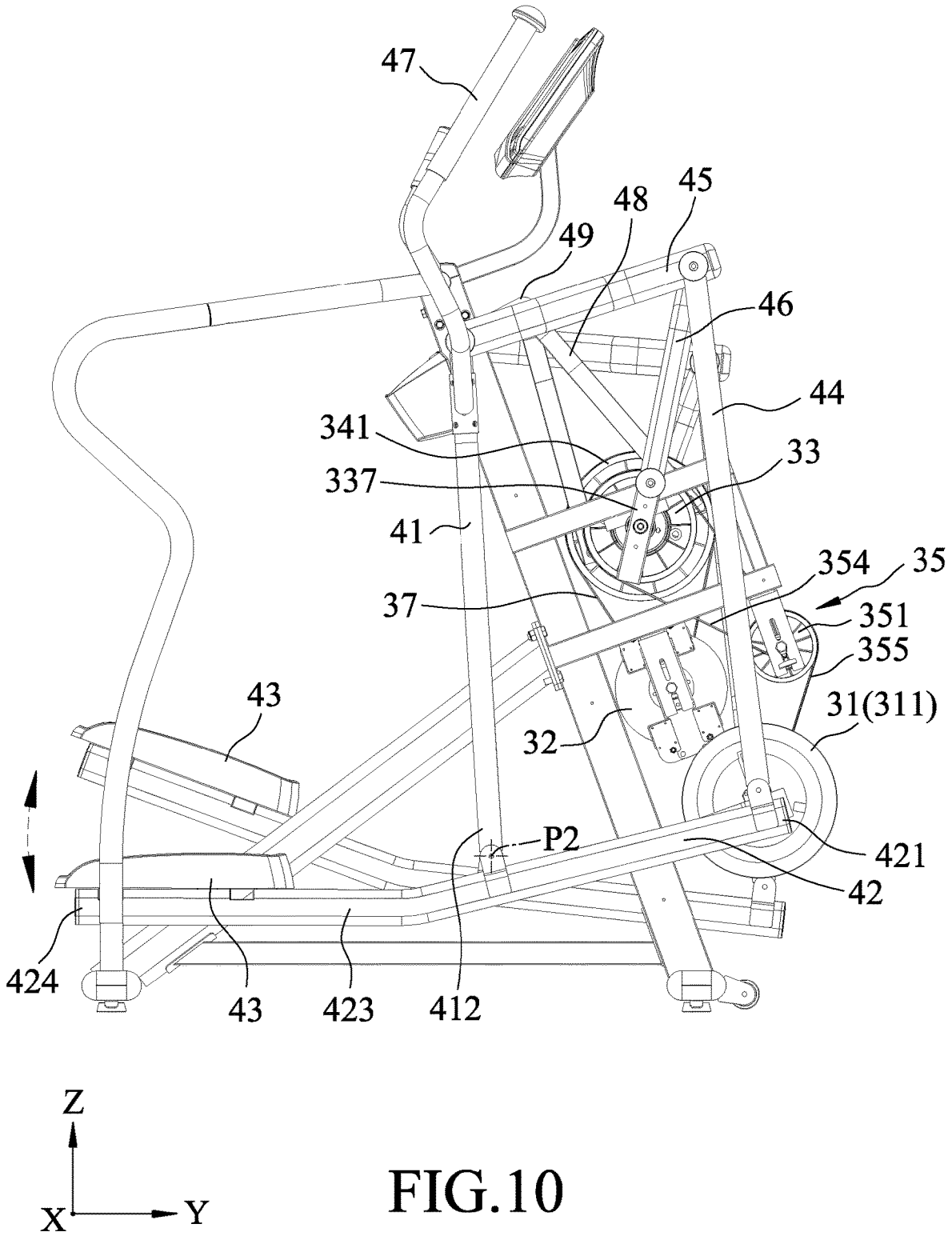
FIG. 10 is similar to FIG. 8, but illustrates how a motion of a stepper exercise device can be performed through operation of the multi-function exercise device.

The connection link 45 has a second rearward link end 451 coupled pivotally to the first upper link end 411 about the first pivot axis (P1), and a second forward link end 452 which is opposite to the second rearward link end 451 in the forward-to-rearward direction (Y), and which is pivotally coupled to the second upper link end 441 about a fourth pivot axis (P4) parallel to the first pivot axis (P1) so as to permit the rear link 41, the support link 42, the front link 44, and the connection link 45 to cooperatively form a four-bar linkage. As shown in FIGS. 8 and 10, when a treading force is exerted on the foot support area 424 about the second pivot axis (P2), the first forward link end 421 is permitted to move upward so as to make upward movement of the front link 44 in the upright direction (Z).

Referring back to FIGS. 4 to 6, the first wheel unit 33 is disposed forwardly of the front support post 22, and is rotatably mounted relative to the front support post 22.

The second wheel unit 34 is disposed forwardly of the front support post 22, and is rotatably mounted relative to the front support post 22.

Each of the first coupler bars 46 is configured to couple the second upper link end 441 of the front link 44 of the respective linkage member 4 to the first wheel unit 33 so as to permit the first wheel unit 33 to be driven to rotate in response to the upward movement of the front link 44 of one of the linkage members 4.

Each of the second coupler bars 48 is configured to couple the first upper link end 411 of the rear link 41 of the respective linkage member 4 to the second wheel unit 34 so as to permit the second wheel unit 34 to be driven to rotate in response to the swinging movement of the rear link 41 about the first pivot axis (P1).

The first load-resistance member 31 is disposed forwardly of the front support post 22 to retard rotational movement of the first wheel unit 33.

The second load-resistance member 32 is disposed forwardly of the front support post 22 to retard rotational movement of the second wheel unit 34.

In an embodiment shown in FIGS. 5 and 6, the first wheel unit 33 may include a rotation axle 331, a first wheel body 330, and two crank arms 337.

The rotation axle 331 is rotatably mounted relative to the front support post 22 about a rotation axis (R) in the left-to-right direction (X), and has a left axle end 332, a right axle end 333, and a middle axle region 334 disposed between the left and right axle ends 332, 333.

The first wheel body 330 is mounted on the middle axle region 334 to rotate with the rotation axle 331 about the rotation axis (R) so as to provide the rotational movement of the first wheel unit 33.

Each of the crank arms 337 is coupled to a respective one of the left and right axle ends 332, 333 to rotate with the rotation axle 331, and extends radially away from the respective one of the left and right axle ends 332, 333 to terminate at a crank end 338 formed with an outer journal 339. The outer journals 339 of the crank arms 338 are oppositely offset from the rotation axis (R) and are configured for coupling with the first coupler bars 46, respectively, so as to permit the first wheel body 330 to be driven to rotate in response to the upward movement.

In an embodiment shown in FIGS. 5, 8, and 10, the first load-resistance member 31 may include a first flywheel 311 which is rotatably mounted relative to the front support post 22 about a first axis (A1) in the left-to-right direction (X). The first flywheel 311 may be made of metal.

In addition, the multi-function exercise device further includes an accelerating unit 35 which includes a first transmission wheel 351, a second transmission wheel 352, a first pulley 353, a first endless belt 354, and a second endless belt 355.

The first transmission wheel 351 is rotatably mounted relative to the front support post 22 about a wheel axis (W) in the left-to-right direction (X).

The second transmission wheel 352 is secured to the first transmission wheel 351 for co-rotation therewith about the wheel axis (W), and has a smaller dimension than the first wheel body 330 and the first transmission wheel 351.

The first pulley 353 is secured to the first flywheel 311 for co-rotation therewith about the first axis (A1), and has a smaller dimension than the first transmission wheel 351 and the first flywheel 311.

The first endless belt 354 is trained on the first wheel body 330 and the second transmission wheel 352 to permit the second transmission wheel 352 to be driven by the first wheel body 330 to rotate about the wheel axis (W) at a faster rotational velocity than the first wheel body 330.

The second endless belt 355 is trained on the first transmission wheel 351 and the first pulley 353 to permit the first pulley 353 to be driven by the first transmission wheel 351 to rotate about the first axis (A1) at a faster rotational velocity than the first transmission wheel 351, thereby allowing the first flywheel 311 to retard the rotational movement of the first wheel unit 33.

Figure 7:
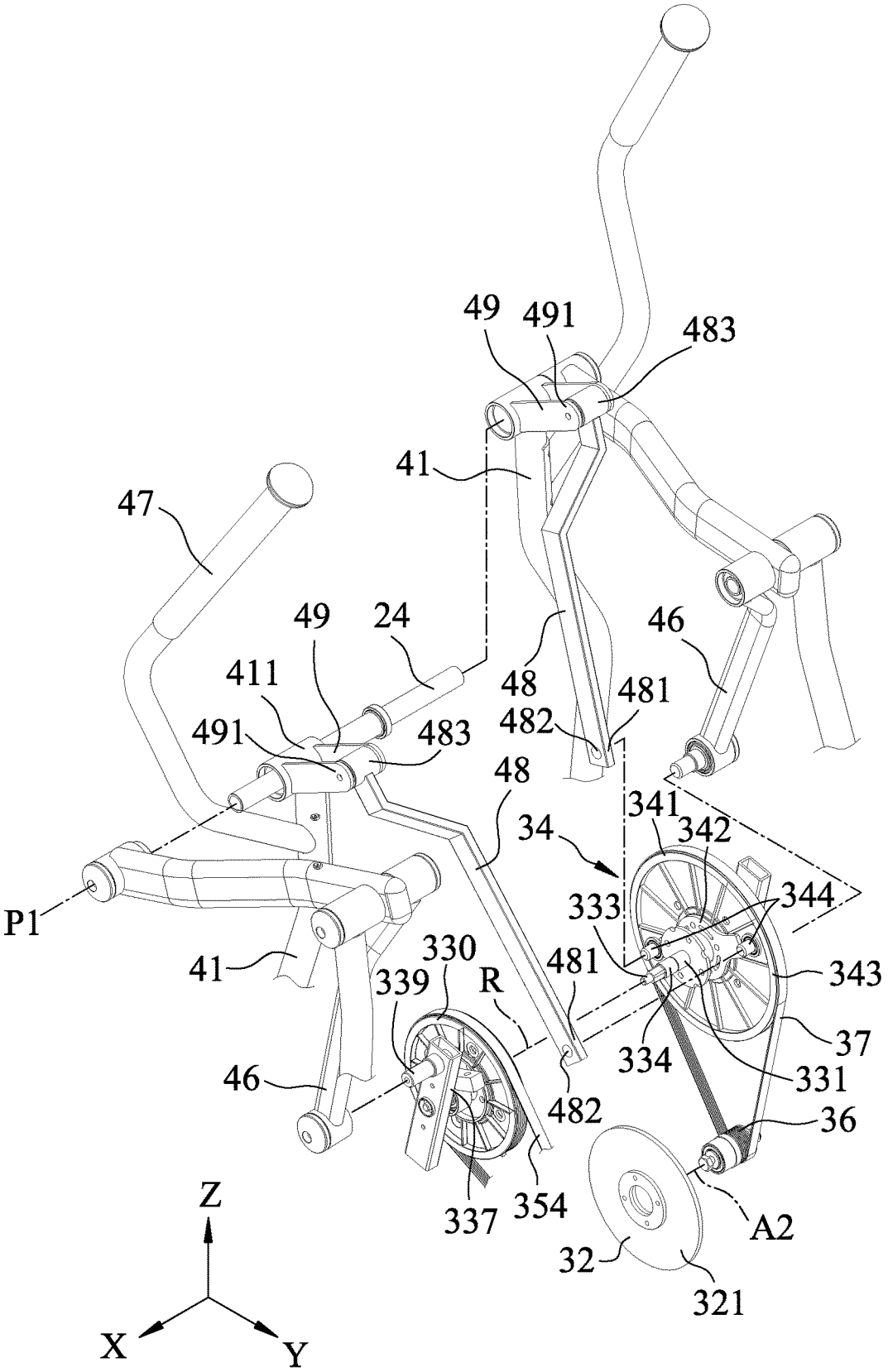
FIG. 7 is another enlarged, fragmentary, partially exploded perspective view of the multi-function exercise device shown in FIG. 4, with certain parts omitted for better illustration.

In an embodiment shown in FIGS. 5 to 7, the middle axle region 334 of the rotation axle 331 has a first axle area 335 and a second axle area 336 displaced from the first axle area 335 in the left-to-right direction (X). The first wheel body 330 is mounted on the first axle area 335.

Furthermore, each of the linkage members 4 further includes a connection arm 49 which extends radially and forwardly from the first upper link end 411 of the rear link 41 to permit the connection arm 49 to swing with the rear link 41 about the first pivot axis (P1) (see FIGS. 8 and 9), and which has a connection end 491 distal from the first upper link end 411.

Moreover, each of the second coupler bars 48 has a first bar end 481 formed with a pin hole 482, and a second bar end 483 which is opposite to the first bar end 481, and which is pivotally connected to the connection end 491 of the connection arm 49 of the respective linkage member 4 about an axis parallel to the first pivot axis (P1).

In addition, the second wheel unit 34 includes a second wheel body 341 and two pins 344.

The second wheel body 341 has a wheel rim 343 extending to surround the rotation axis (R), and a hub 342 which is surrounded by the wheel rim 343, and which is mounted on the second axle area 336 shown in FIG. 6 to be rotatable relative to the rotation axle 331 about the rotation axis (R) so as to permit the second wheel body 341 to provide the rotational movement of the second wheel unit 34.

The pins 344 are mounted on the second wheel body 341 between the hub 342 and the wheel rim 343 to be diametrically opposite to each other, and are configured to be respectively inserted in the pin holes 482 of the second coupler bars 48 so as to permit the second wheel unit 34 to be driven by the second coupler bars 48 to rotate about the rotation axis (R) in response to the swinging movement of the rear link 41.

In an embodiment shown in FIGS. 5 and 7, the second load-resistance member 32 may include a second flywheel 321 which is rotatably mounted relative to the front support post 22 about a second axis (A2) in the left-to-right direction (X). The second flywheel 321 may be made of metal.

Furthermore, the multi-function exercise device may further include a second pulley 36 and a third endless belt 37.

The second pulley 36 is secured to the second flywheel 321 for co-rotation therewith about the second axis (A2), and has a smaller dimension than the second wheel body 341 and the second flywheel 321.

The third endless belt 37 is trained on the wheel rim 343 of the second wheel body 341 and the second pulley 36 to permit the second pulley 36 to be driven by the second wheel body 341 to rotate about the second axis (A2) at a faster rotational velocity than the second wheel body 341, thereby allowing the second flywheel 321 to retard the rotational movement of the second wheel unit 34.

In an embodiment shown in FIG. 5, each of the linkage members 4 further includes an actuating grip bar 47 connected to the rear link 41 in proximity to the first upper link end 411 so as to enable the actuating grip bar 47 to actuate the swinging movement of the rear link 41 about the first pivot axis (P1).

In an embodiment shown in FIGS. 4-6, the multi-function exercise device may further include two foot pedals 43 which are mounted on the foot support areas 424 of the link extensions 423 of the linkage members 4, respectively.

In an embodiment shown in FIG. 5, the base 21 may include a front rail 212 and a rear rail 213. The front rail 212 extends in the left-to-right direction (X) to terminate at two front rail ends 214. The rear rail 213 is spaced apart from the front rail 212 in the forward-to-rearward direction (Y), and extends in the left-to-right direction (X) to terminate at two rear rail ends 216. The front support post 22 extends upwardly from a middle region 215 of the front rail 212 between the front rail ends 214.

Furthermore, the supporting frame 2 may further include an inclined support member 25 and an interconnecting bar 211. The inclined support member 25 extends upwardly and inclinedly from a middle region 217 of the rear rail 213 between the rear rail ends 216 to be secured to amid region 223 of the front support post 22 between the upper end segment 222 and the front rail 212. The interconnecting bar 211 is disposed under the inclined support member 25, and extends in the forward-to-rearward direction (Y) to interconnect the inclined support member 25 and the front support post 22.

In an embodiment shown in FIG. 5, the supporting frame 2 may further include two handle bars 26 which are disposed leftwardly and rightwardly of the front support post 22, respectively. Each of the handle bars 26 has an upper bar end 261 connected to the upper end segment 222 of said front support post 22, and a lower bar end 262 connected to a respective one of the rear rail ends 216 of the rear rail 213.

In an embodiment shown in FIG. 4, the supporting frame 2 may further include a front mounting piece 230, a pair of lower beams 231, and a pair of upper beams 232.

The front mounting piece 230 is spaced apart from the front support post 22 in the forward-to-rearward direction (Y), and is disposed forwardly of the first and second wheel units 33, 34.

The upper beams 232 are disposed leftwardly and rightwardly of the front support post 22, respectively, and each of the upper beams 232 extends in the forward-to-rearward direction (Y) to interconnect the front support post 22 and the front mounting piece 230. The rotation axle 331 may be rotatably mounted to the upper beams 232, and is thus rotatably mounted relative to the front support post 22.

The lower beams 231 are disposed leftwardly and rightwardly of the front support post 22, respectively, and each of the lower beams 231 extends in the forward-to-rearward direction (Y) to interconnect the front support post 22 and the front mounting piece 230. The first transmission wheel 351 may be rotatably mounted to a right one of the lower beams 231, and is thus rotatably mounted relative to the front support post 22.

Besides, the second flywheel 321 may be disposed rearwardly of the first transmission wheel 351 to be rotatably mounted to the right one of the lower beams 231, and is thus rotatably mounted relative to the front support post 22.

When the multi-function exercise device is used for exercise, an external force exerted on each of the foot pedals 43 can be resolved into two fractional forces perpendicular to each other, one of which is parallel to the forward-to-rearward direction (Y) and is called a Y-component force, and the other of which is parallel to the upright direction (Z) and is called a Z-component force.

Figure 9:
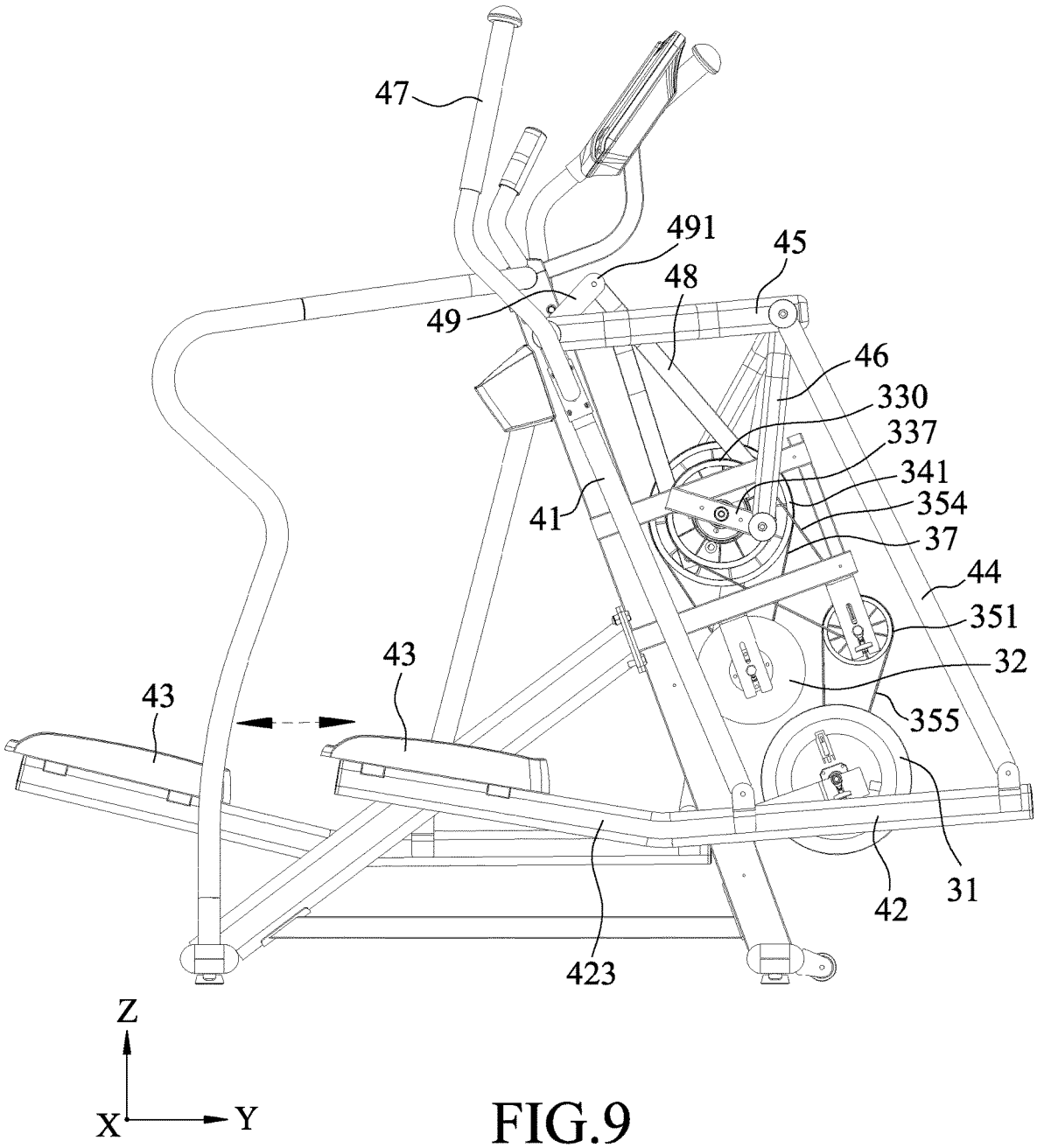
FIG. 9 is similar to FIG. 8, but illustrates how a motion of a glider exercise device can be performed through operation of the multi-function exercise device.

With reference to FIGS. 8 and 9, when the Y-component force is much greater than the Z-component force to permit the rear links 41 of the linkage members 4 to alternately swing back and forth, a majority of the resistance to the external force is provided by the second load-resistance member 32 through the second coupler bars 48, the second wheel unit 34, the second pulley 36 shown in FIG. 7, and the third endless belt 37. In this case, the multi-function exercise device can perform a motion achievable by a glider exercise device.

With reference to FIGS. 8 and 10, when the rear link 41 is kept not swinging, and when the Z-component force is much greater than the Y-component force to permit the alternate upward movement of the front links 44 of the linkage members 4, a majority of the resistance to the external force is provided by the first load-resistance member 31 through the first coupler bars 46, the first wheel unit 33, and the accelerating unit 35. In this case, the multi-function exercise device can perform a motion achievable by a stepper exercise device.

Figure 11:
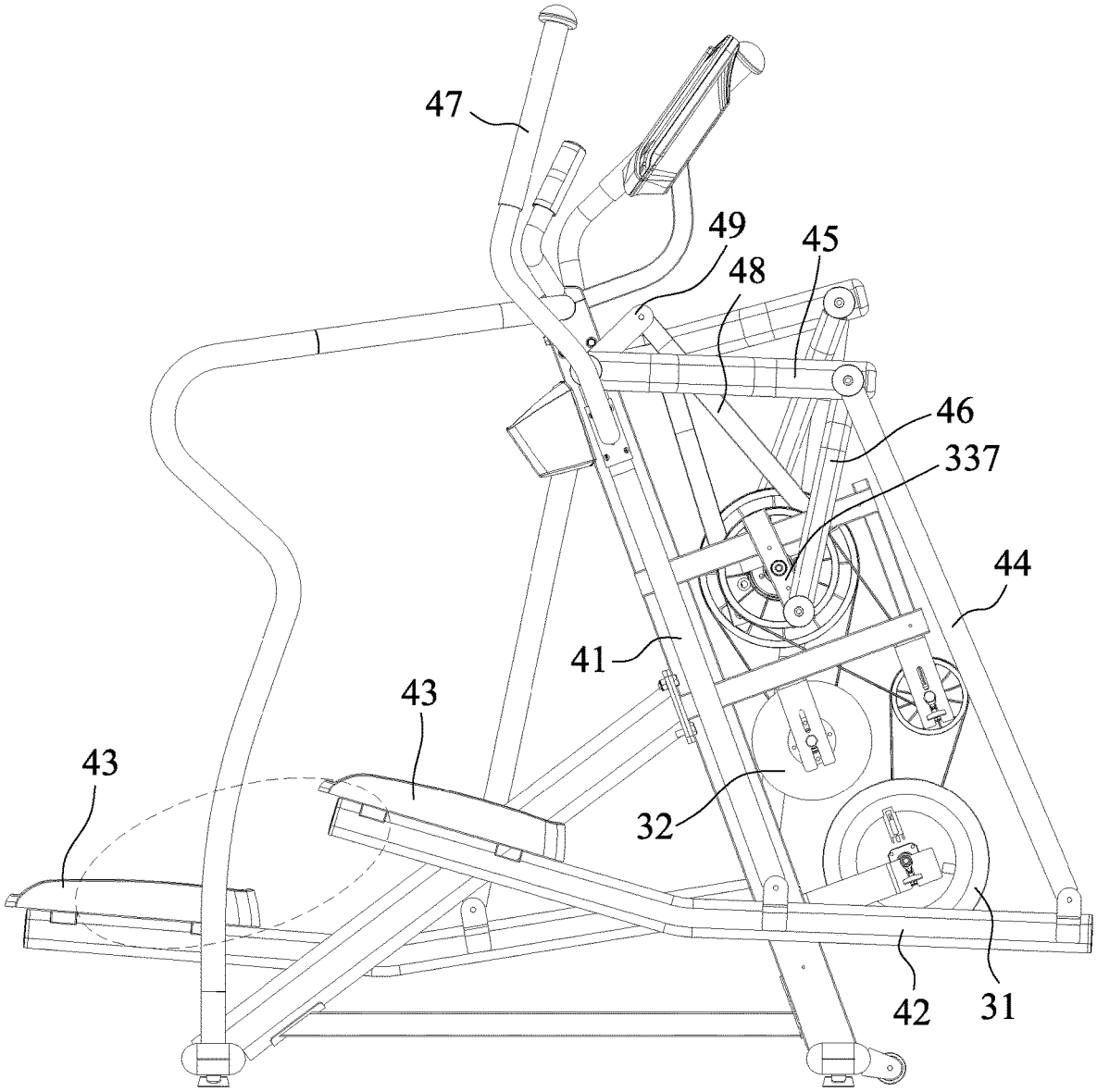
FIG. 11 is similar to FIG. 8, but illustrates how a motion of an elliptical exercise device can be performed through operation of the multi-function exercise device.
Figure 11:
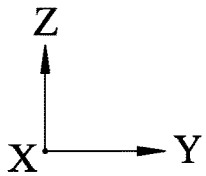
Figure 12:
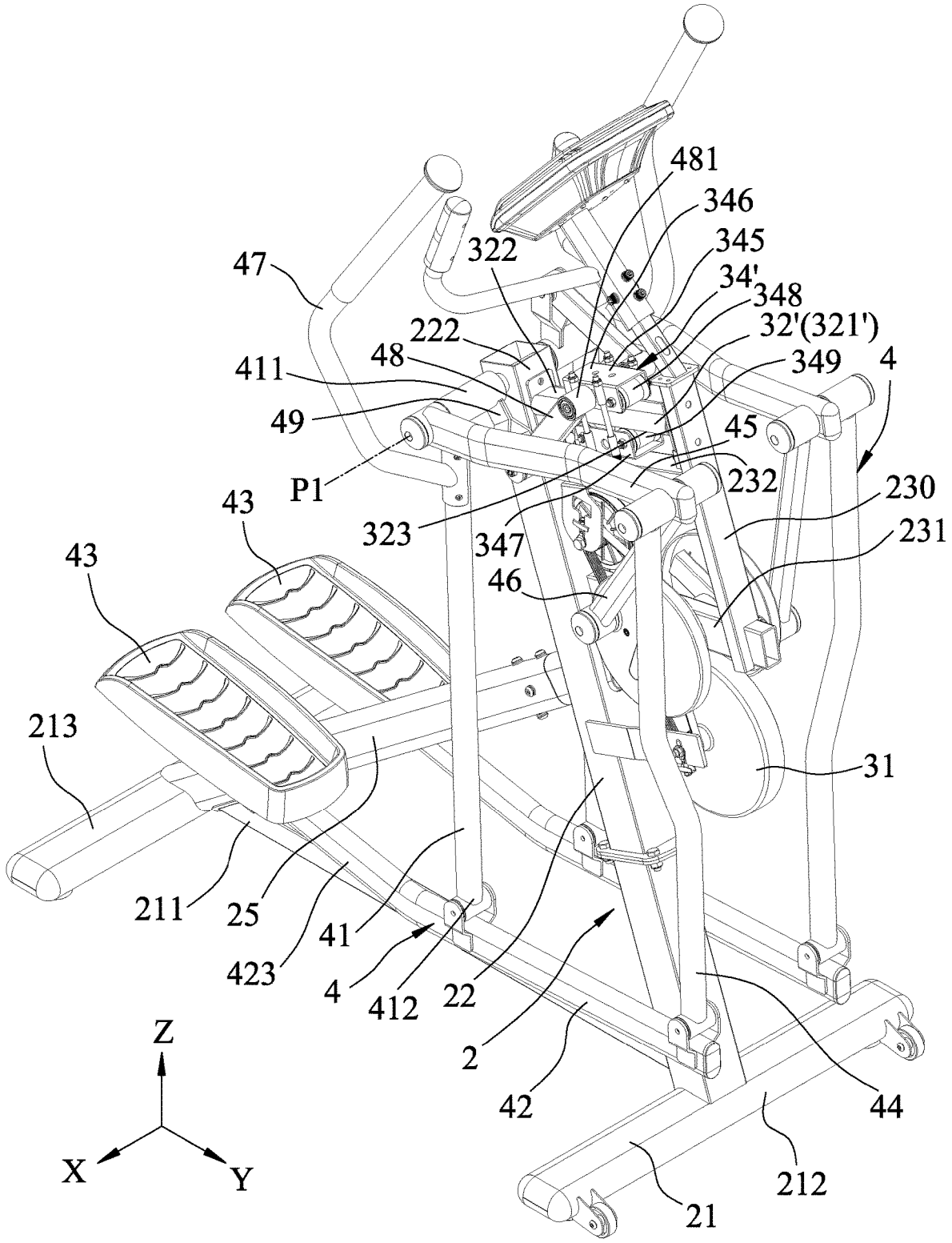
FIG. 12 is a perspective view of a multi-function exercise device according to a second embodiment of the disclosure.

With reference to FIGS. 8 and 11, when the Y-component and Z-component forces are not much different from each other to permit the rear links 41 of the linkage members 4 to alternately swing back and forth and to permit the alternate upward movement of the front links 44 of the linkage members 4, the resistance to the external force is provided by both the first and second load-resistance members 31, 32. In this case, the multi-function exercise device can perform a motion achievable by an elliptical exercise device.

In addition, the distance of the horizontal movement of each of the foot pedals 43 may be altered by changing the swing angle of the corresponding rear link 41.

FIGS. 12-15 illustrate a multi-function exercise device according to a second embodiment of the disclosure. The second embodiment is similar to the first embodiment, except the second load-resistance member and the second wheel unit.

In the second embodiment, the second load-resistance member 32' includes a guiding rail 321' which extends forwardly from the upper end segment 222 of the front support post 22, and which has an upper friction surface 322 and a lower friction surface 323 opposite to the upper friction surface 322 in the upright direction (Z).

The second wheel unit 34' includes a guided frame 345, at least one upper roller 348, and at least one lower roller 349.

The guided frame 345 is configured to be guided by and moved along the guiding rail 321', and is coupled to and driven by the first bar ends 481 of the second coupler bars 48 to make a reciprocal to-and-fro movement on the guiding rail 321' in response to the swinging movement of the rear link 41 about the first pivot axis (P1). The guided frame 345 has an upper frame half 346 disposed upwardly of the guiding rail 321', and a lower frame half 347 disposed downwardly of the guiding rail 321'.

Each of the upper and lower rollers 348, 349 is rotatably mounted on a respective one of the upper and lower frame halves 346, 347 about a roller axis (RA) in the left-to-right direction (X) for permitting the upper and lower rollers 348, 349 to provide the rotational movement of the second wheel unit 34'. In addition, Each of the upper and lower rollers 348, 349 is rollable on a respective one of the upper and lower friction surfaces 322, 323 in response to the reciprocal to-and-fro movement of the guided frame 345, so as to permit the guiding rail 321' to retard the rotational movement of the second wheel unit 34'.

Figure 14:
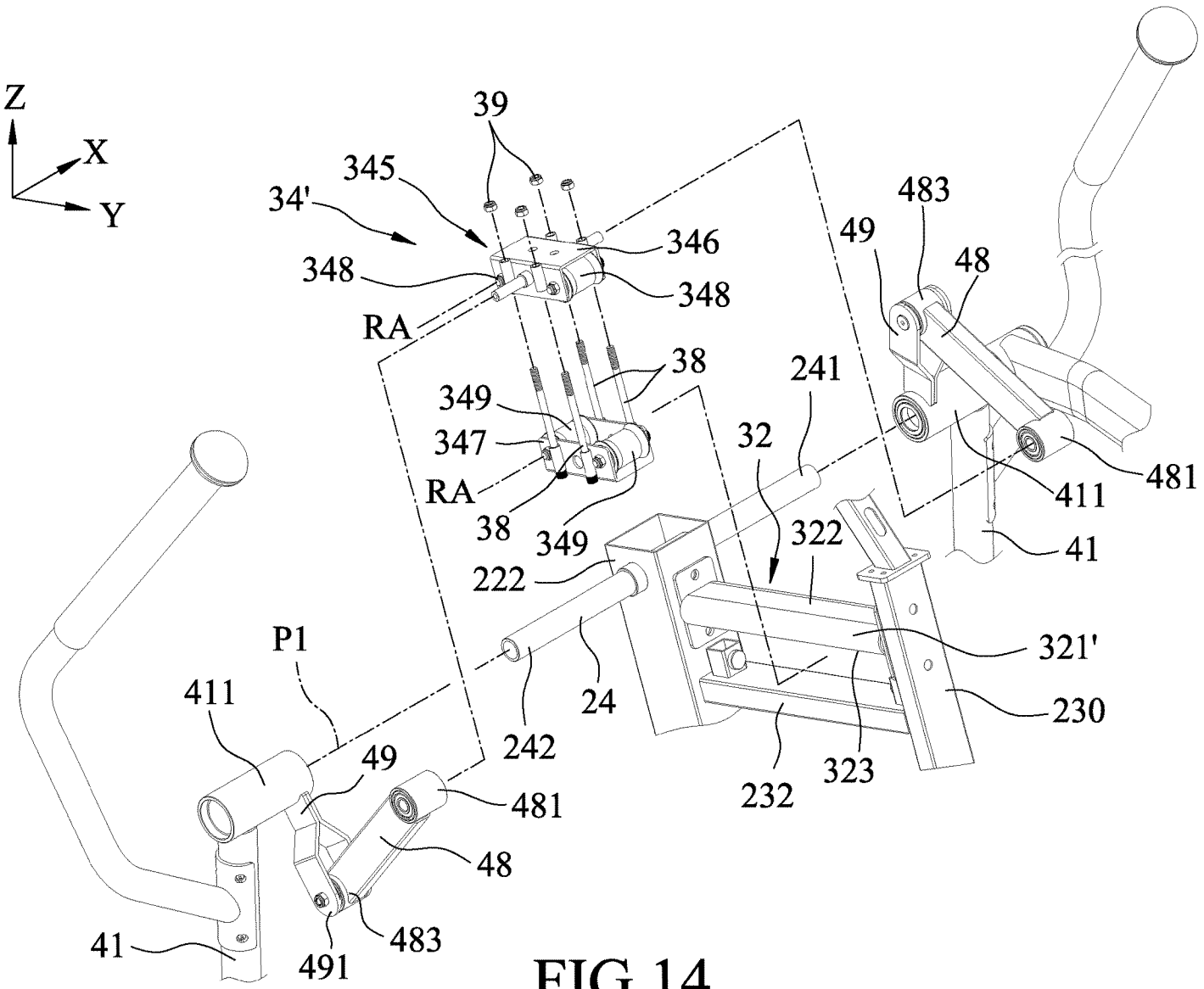
FIG. 14 is an enlarged, fragmentary, partially exploded perspective view of the multi-function exercise device shown in FIG. 12, with certain parts omitted for better illustration.
Figure 15:
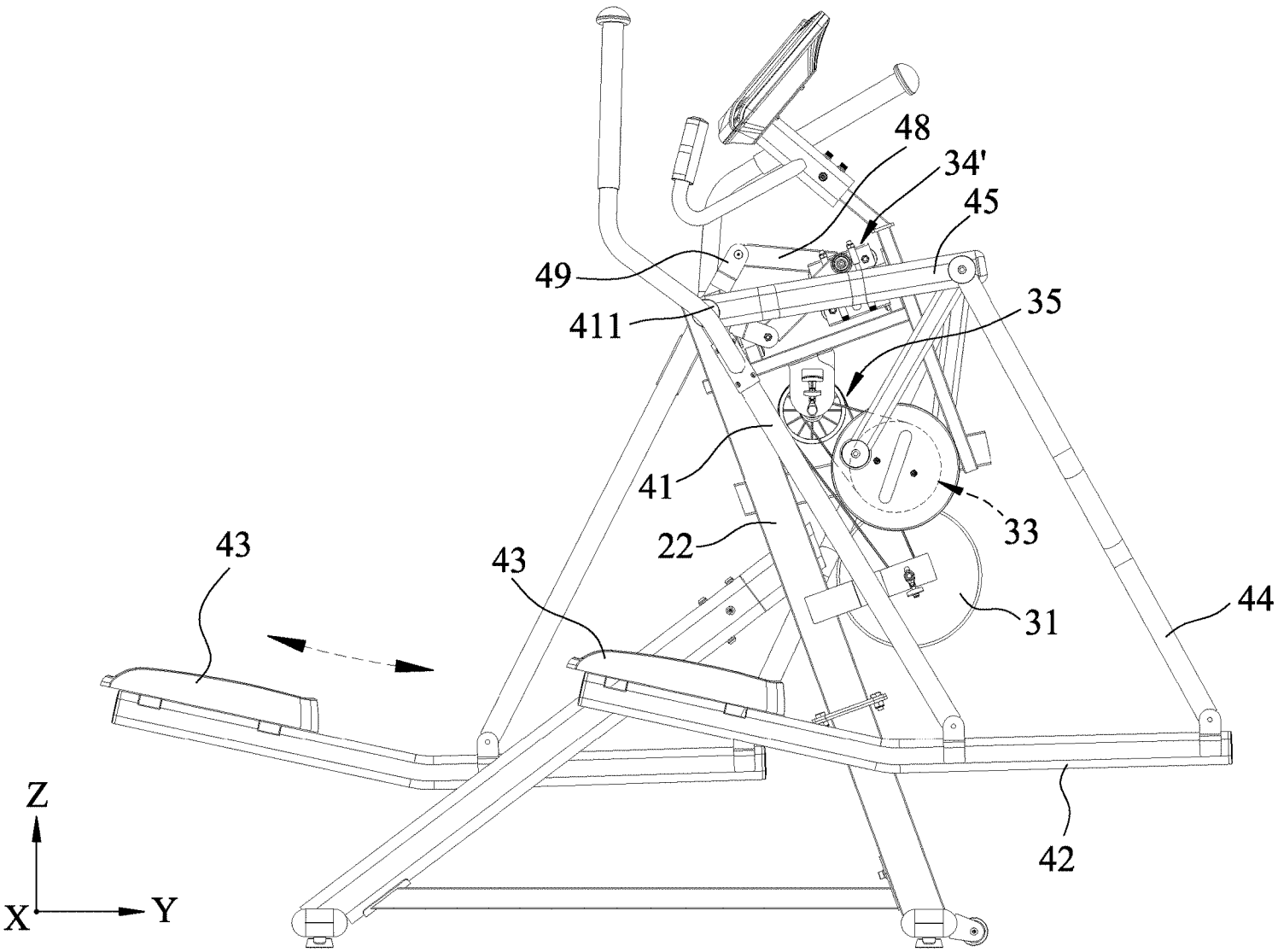
FIG. 15 is aside view of the multi-function exercise device shown in FIG. 12, illustrating how a motion of a glider exercise device can be performed through operation of the multi-function exercise device.

In an embodiment shown in FIG. 14, the second wheel unit 34' may include two of the upper rollers 348 displaced from each other in the forward-to-rearward direction (Y), and two of the lower rollers 349 displaced from each other in the forward-to-rearward direction (Y). The number of the upper/lower rollers 348/349 may be varied based on design requirements.

In an embodiment shown in FIG. 14, the upper and lower frame halves 346, 347 may be coupled to each other by a plurality of screw members 38 and corresponding nuts 39.

Figure 13:
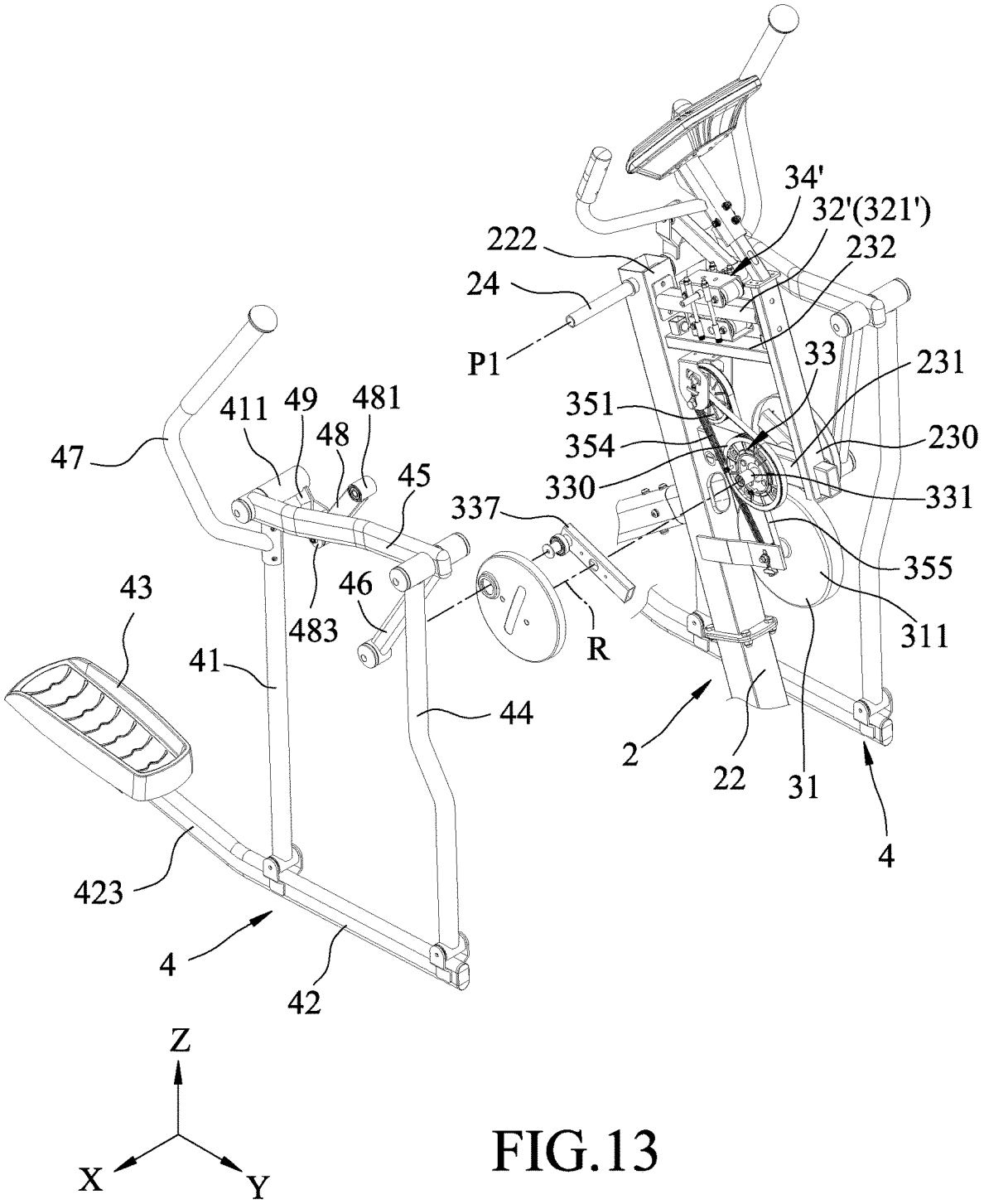
FIG. 13 is a fragmentary, partially exploded perspective view of the multi-function exercise device shown in FIG. 12, with certain parts omitted for better illustration.

In an embodiment shown in FIG. 13, the supporting frame 2 may include a front mounting piece 230 similar to the first embodiment, a lower beam 231, and an upper beam 232 spaced apart from the lower beam 231 in the upright direction (Z). Each of the lower and upper beams 231, 232 and the guiding rail 321' extends forwardly from the front support post 22 to be connected to the front mounting piece 230.

In addition, the rotation axle 331 may be rotatably mounted to the lower beam 231, and is thus rotatably mounted relative to the front support post 22. The first transmission wheel 351 may be rotatably mounted to the upper beam 232, and is thus rotatably mounted relative to the front support post 22.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A multi-function exercise device comprising:

a supporting frame including a base configured to rest on a floor surface, a front support post extending upwardly from said base to terminate at an upper end segment, and a pivot shaft extending along a first pivot axis in a left-to-right direction through said upper end segment to terminate at a left shaft end segment and a right shaft end segment;

a pair of linkage members which are respectively disposed leftward and rightward of said front support post, each of said linkage members including a rear link having a first lower link end, and a first upper link end which is opposite to said first lower link end in an upright direction, and which is pivotally coupled on a respective one of said left and right shaft end segments about said first pivot axis to permit swinging movement of said rear link about said first pivot axis, a support link having a first forward link end, and a first rearward link end which is opposite to said first forward link end in a forward-to-rearward direction, and which is pivotally coupled to said first lower link end about a second pivot axis parallel to said first pivot axis, a link extension extending rearwardly from said first rearward link end to form a foot support area, a front link having a second upper link end, and a second lower link end which is opposite to said second upper link end in the upright direction, and which is pivotally coupled to said first forward link end about a third pivot axis parallel to said first pivot axis, and a connection link having a second rearward link end coupled pivotally to said first upper link end about said first pivot axis, and a second forward link end which is opposite to said second rearward link end in the forward-to-rearward direction, and which is pivotally coupled to said second upper link end about a fourth pivot axis parallel to said first pivot axis so as to permit said rear link, said support link, said front link, and said connection link to respectively move relative to one another and cooperatively form a four-bar linkage such that when a treading force is exerted on said foot support area about said second pivot axis, said first forward link end is permitted to move upward so as to make upward movement of said front link in the upright direction;

a first wheel unit which is disposed forwardly of said front support post, and which is rotatably mounted relative to said front support post;

a second wheel unit which is disposed forwardly of said front support post, and which is rotatably mounted relative to said front support post;

a pair of first coupler bars each of which is configured to couple said second upper link end of said front link of said respective linkage member to said first wheel unit so as to permit said first wheel unit to be driven to rotate in response to said upward movement of said front link of one of said linkage members;

a pair of second coupler bars each of which is configured to couple said first upper link end of said rear link of said respective linkage member to said second wheel unit so as to permit said second wheel unit to be driven to rotate in response to said swinging movement of said rear link about said first pivot axis;

a first load-resistance member disposed forwardly of said front support post to retard rotational movement of said first wheel unit; and a second load-resistance member disposed forwardly of said front support post to retard rotational movement of said second wheel unit.

2. The multi-function exercise device according to claim 1, wherein said first wheel unit includes a rotation axle which is rotatably mounted relative to said front support post about a rotation axis in the left-to-right direction, and which has a left axle end, a right axle end, and a middle axle region disposed between said left and right axle ends, a first wheel body which is mounted on said middle axle region to rotate with said rotation axle about said rotation axis to provide said rotational movement of said first wheel unit, and two crank arms, each of which is coupled to a respective one of said left and right axle ends to rotate with said rotation axle, and each of which extends radially away from said respective one of said left and right axle ends to terminate at a crank end formed with an outer journal, said outer journals of said crank arms being oppositely offset from said rotation axis, and being configured for coupling with said first coupler bars, respectively, so as to permit said first wheel body to be driven to rotate in response to said upward movement.

3. The multi-function exercise device according to claim 2, wherein said first load-resistance member includes a first flywheel which is rotatably mounted relative to said front support post about a first axis in the left-to-right direction, said multi-function exercise device further comprising an accelerating unit which includes a first transmission wheel which is rotatably mounted relative to said front support post about a wheel axis in the left-to-right direction, a second transmission wheel which is secured to said first transmission wheel for co-rotation therewith about said wheel axis, and which has a smaller dimension than said first wheel body and said first transmission wheel, a first pulley which is secured to said first flywheel for co-rotation therewith about said first axis, and which has a smaller dimension than said first transmission wheel and said first flywheel, a first endless belt which is trained on said first wheel body and said second transmission wheel to permit said second transmission wheel to be driven by said first wheel body to rotate about said wheel axis at a faster rotational velocity than said first wheel body, and a second endless belt which is trained on said first transmission wheel and said first pulley to permit said first pulley to be driven by said first transmission wheel to rotate about said first axis at a faster rotational velocity than said first transmission wheel, thereby allowing said first flywheel to retard said rotational movement of said first wheel unit.

4. The multi-function exercise device according to claim 2, wherein said middle axle region of said rotation axle has a first axle area and a second axle area displaced from said first axle area in the left-to-right direction, said first wheel body being mounted on said first axle area, each of said linkage members further includes a connection arm which extends radially and forwardly from said first upper link end of said rear link to permit said connection arm to swing with said rear link about said first pivot axis, and which has a connection end distal from said first upper link end, each of said second coupler bars has a first bar end formed with a pin hole, and a second bar end which is opposite to said first bar end, and which is pivotally connected to said connection end of said connection arm of said respective linkage member, said second wheel unit including a second wheel body having a wheel rim extending to surround said rotation axis, and a hub which is surrounded by said wheel rim, and which is mounted on said second axle area to be rotatable relative to said rotation axle about said rotation axis so as to permit said second wheel body to provide said rotational movement of said second wheel unit, and two pins which are mounted on said second wheel body between said hub and said wheel rim to be diametrically opposite to each other, and which are configured to be respectively inserted in said pin holes of said second coupler bars so as to permit said second wheel unit to be driven by said second coupler bars to rotate about said rotation axis in response to said swinging movement of said rear link.

5. The multi-function exercise device according to claim 4, wherein said second load-resistance member includes a second flywheel which is rotatably mounted relative to said front support post about a second axis in the left-to-right direction, said multi-function exercise device further comprising a second pulley which is secured to said second flywheel for co-rotation therewith about said second axis, and which has a smaller dimension than said second wheel body and said second flywheel, and a third endless belt which is trained on said wheel rim of said second wheel body and said second pulley to permit said second pulley to be driven by said second wheel body to rotate about said second axis at a faster rotational velocity than said second wheel body, thereby allowing said second flywheel to retard said rotational movement of said second wheel unit.

6. The multi-function exercise device according to claim 1, wherein said second load-resistance member includes a guiding rail which extends forwardly from said upper end segment of said front support post, and which has an upper friction surface and a lower friction surface opposite to said upper friction surface in the upright direction, each of said linkage members further includes a connection arm which extends radially and forwardly from said first upper link end of said rear link to permit said connection arm to swing with said rear link about said first pivot axis, and which has a connection end, and each of said second coupler bars has a first bar end, and a second bar end which is pivotally connected to said connection end of said connection arm of said respective linkage member, said second wheel unit including a guided frame which is configured to be guided by and moved along said guiding rail, and which is coupled to and driven by said first bar ends of said second coupler bars to make a reciprocal to-and-fro movement on said guiding rail in response to said swinging movement of said rear link about said first pivot axis, said guided frame having an upper frame half disposed upwardly of said guiding rail, and a lower frame half disposed downwardly of said guiding rail, and at least one upper roller and at least one lower roller, each of which is rotatably mounted on a respective one of said upper and lower frame halves about a roller axis in the left-to-right direction for permitting said upper and lower rollers to provide said rotational movement of said second wheel unit, and each of which is rollable on a respective one of said upper and lower friction surfaces in response to said reciprocal to-and-fro movement of said guided frame, so as to permit said guiding rail to retard said rotational movement of said second wheel unit.

7. The multi-function exercise device according to claim 1, wherein each of said linkage members further includes an actuating grip bar connected to said rear link in proximity to said first upper link end so as to enable said actuating grip bar to actuate said swinging movement of said rear link about said first pivot axis.

8. The multi-function exercise device according to claim 1, further comprising two foot pedals which are mounted on said foot support areas of said link extensions of said linkage members, respectively.

9. The multi-function exercise device according to claim 1, wherein said base includes a front rail extending in the left-to-right direction to terminate at two front rail ends, and a rear rail which is spaced apart from said front rail in the forward-to-rearward direction, and which extends in the left-to-right direction to terminate at two rear rail ends, said front support post extending upwardly from a middle region of said front rail between said front rail ends, said supporting frame further including an inclined support member extending upwardly and inclinedly from a middle region of said rear rail between said rear rail ends to be secured to a mid region of said front support post between said upper end segment and said front rail, and an interconnecting bar which is disposed under said inclined support member, and which extends in the forward-to-rearward direction to interconnect said inclined support member and said front support post.

10. The multi-function exercise device according to claim 9, wherein said supporting frame further includes two handle bars which are disposed leftwardly and rightwardly of said front support post, respectively, each of said handle bars having an upper bar end connected to said upper end segment of said front support post, and a lower bar end connected to a respective one of said rear rail ends of said rear rail.

* * * * *